US007114309B2

(12) United States Patent
Ausnit

(10) Patent No.: US 7,114,309 B2
(45) Date of Patent: Oct. 3, 2006

(54) METHOD AND APPARATUS FOR MAKING RECLOSABLE PACKAGES HAVING SLIDER-ACTUATED STRING ZIPPERS

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 80 days.

(21) Appl. No.: 11/034,488

(22) Filed: Jan. 12, 2005

(65) Prior Publication Data

US 2005/0120678 A1 Jun. 9, 2005

Related U.S. Application Data

(63) Continuation-in-part of application No. 10/340,422, filed on Jan. 10, 2003, now abandoned.

(51) Int. Cl.
*B65B 61/18* (2006.01)

(52) U.S. Cl. ..... 53/412; 53/133.4; 53/139.2; 53/545

(58) Field of Classification Search ..... 53/412, 53/450, 452, 133.4, 139.2, 545, 547, 548, 53/551, 552, 558; 493/213, 927; 383/63, 383/64, 65; 24/400
See application file for complete search history.

(56) References Cited

U.S. PATENT DOCUMENTS 4,601,694 A * 7/1986 Ausnit ..... 493/213
4,756,628 A * 7/1988 Branson ..... 383/63
4,807,300 A * 2/1989 Ausnit et al. ..... 383/65
4,812,074 A * 3/1989 Ausnit et al. ..... 493/213
5,334,127 A * 8/1994 Bruno et al. ..... 383/63
5,400,568 A * 3/1995 Kanemitsu et al. ..... 53/412
5,558,613 A * 9/1996 Tilman et al. ..... 493/213
5,927,855 A * 7/1999 Tomic et al. ..... 383/63
5,983,466 A * 11/1999 Petkovsek ..... 24/400
6,138,329 A * 10/2000 Johnson ..... 383/63
6,220,754 B1 * 4/2001 Stiglic et al. ..... 383/64
6,581,358 B1 * 6/2003 Buchman ..... 53/412
6,595,689 B1 * 7/2003 Borchardt et al. ..... 383/64
6,609,827 B1 * 8/2003 Bois et al. ..... 24/400
6,863,645 B1 * 3/2005 Crunkleton et al. ..... 493/213
6,884,208 B1 * 4/2005 Haws ..... 493/213
6,925,688 B1 * 8/2005 Savicki ..... 24/30.5 R
6,941,726 B1 * 9/2005 Ausnit ..... 53/412

(Continued)

*Primary Examiner*—Louis Huynh
(74) *Attorney, Agent, or Firm*—Ostrager Chong Flaherty & Broitman P.C.

(57) ABSTRACT

Methods and apparatus for making reclosable packages having slider-actuated string zippers. More specifically, one method comprises the following steps: (a) providing an elongated web of packaging film having first and second edges that are substantially mutually parallel; (b) joining a back of a first flangeless zipper strip to the web along a first band-shaped zone that is substantially parallel to the first edge; (c) joining a back of a second flangeless zipper strip to the web along a second band-shaped zone that is substantially parallel to the second edge; (d) folding the web to form a first folded side and a second folded side interconnected by a folded section, the first and second folded sides being substantially vertical and the folded section being at the bottom, and the first and second flangeless zipper strips being substantially aligned with each other; (e) joining the first and second folded sides to each other along lines substantially transverse to the first and second flangeless zipper strips and spaced at regular intervals to form cross seals with pockets therebetween; (f) loading product into each pocket; and (g) inserting sliders at spaced intervals along the first and second flangeless zipper strips, one slider per pocket.

22 Claims, 10 Drawing Sheets

U.S. PATENT DOCUMENTS 6,942,608 B1 * 9/2005 Linton et al. ..... 493/213
6,951,421 B1 * 10/2005 Crunkleton et al. ..... 383/64
7,036,987 B1 * 5/2006 Crunkleton et al. ..... 383/64
2005/0138893 A1 * 6/2005 Ausnit ..... 53/412
2005/0281491 A1 * 12/2005 Ausnit ..... 383/64
2005/0284106 A1 * 12/2005 Ausnit ..... 53/412
2006/0021295 A1 * 2/2006 Schneider et al. ..... 53/412
2006/0079386 A1 * 4/2006 Ausnit ..... 493/394

* cited by examiner

METHOD AND APPARATUS FOR MAKING RECLOSABLE PACKAGES HAVING SLIDER-ACTUATED STRING ZIPPERS

RELATED PATENT APPLICATION

This application is a continuation-in-part of and claims priority U.S. patent application Ser. No. 10/340,422 filed on Jan. 10, 2003 and entitled "Method for Dual Manufacture of Reclosable Bags on HFVF Machine", now abandoned.

BACKGROUND OF THE INVENTION

This invention generally relates to methods and apparatus for forming, filling and sealing reclosable packages. In particular, this invention relates to methods and apparatus for forming, filling and sealing reclosable packages having slider-actuated string zippers.

Reclosable bags are finding ever-growing acceptance as primary packaging, particularly as packaging for foodstuffs such as cereal, fresh fruit and vegetables, snacks and the like. Such bags provide the consumer with the ability to readily store, in a closed, if not sealed, package any unused portion of the packaged product even after the package is initially opened.

Reclosable bags comprise a receptacle having a mouth with a zipper for opening and closing. In recent years, many zippers have been designed to operate with a slider mounted thereon. As the slider is moved in an opening direction, the slider causes the zipper sections it passes over to open. Conversely, as the slider is moved in a closing direction, the slider causes the zipper sections it passes over to close. Typically, a zipper for a reclosable bag includes a pair of interlockable profiled closure strips that are joined at opposite ends of the bag mouth. The profiles of interlockable plastic zipper parts can take on various configurations, e.g. interlocking rib and groove elements having so-called male and female profiles, interlocking alternating hook-shaped closure elements, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger or plow in the middle or at one end that is inserted between the zipper profiles to force them apart as the slider is moved along the zipper in an opening direction. The other end of the slider is sufficiently narrow to force the zipper profiles into engagement and close the zipper when the slider is moved along the zipper in a closing direction.

In the past, many interlocking closure strips were formed integrally with the bag making film, for example, by extruding the bag making film with the closure strips formed on the film. Such constructions, however, were limited by the conditions required to extrude both the film and zipper together. To avoid such limitations, many bag designs entail separate extrusion of the closure strips, which are subsequently joined to the bag making film, for example, by conduction heat sealing. These separate closure strips typically have flanges extending therefrom in such a way that the flanges can be joined to bag making film in order to attach the closure strips to the film. Until recently, slider-operated, separately extruded zippers used flange-type constructions.

An alternative zipper design is the so-called flangeless or string zipper, which has substantially no flange portion above or below the interlockable closure profiles. In the case of a string zipper, the bag making film is joined to the backs of the bases of the closure strips. String zippers can be produced at much greater speeds and in greater multiples, allow much greater footage to be wound on a spool, thereby requiring less set-up time, and use less material than flanged zippers, enabling a substantial reduction in the cost of manufacture and processing.

Recently, slider-operated, separately extruded zippers that do not use flange-type constructions have been disclosed. U.S. patent application Ser. No. 10/367,450, entitled "Reclosable Packaging Having Slider-Operated String Zipper", discloses a reclosable bag in which respective marginal portions of the bag film are sealed to the backs of respective flangeless zipper strips. The resulting string zipper is actuated by means of a straddling-type slider that separates the zipper strips during opening. U.S. patent application Ser. No. 10/436,433, entitled "Method and Apparatus for Inserting Sliders During Automated Manufacture of Reclosable Bags", discloses methods and apparatus for manufacturing reclosable bags having slider-actuated string zippers, including methods and apparatus for inserting sliders with plows on string zippers.

There is a need for form-fill-seal (FFS) machines designed to package products in reclosable packages having slider-actuated string zippers. Such machines should include devices for inserting sliders. The sliders may have plows or not.

BRIEF DESCRIPTION OF THE INVENTION

The present invention is directed to form-fill-seal (FFS) machines for making reclosable packages having slider-actuated string zippers and to related methods of manufacture, wherein a string zipper (or two string zippers in the case of dual manufacture) is attached to the bag making film either while the film is horizontal and before the film is folded, or after the film has been folded into a vertically disposed U shape (or W shape in the case of dual manufacture), in which case the string zipper is attached to vertically disposed portions of the film.

One aspect of the invention is a method of making reclosable packages, comprising the following steps: (a) providing an elongated web of packaging film having first and second edges that are substantially mutually parallel; (b) joining a back of a first flangeless zipper strip to the web along a first band-shaped zone that is substantially parallel to the first edge; (c) joining a back of a second flangeless zipper strip to the web along a second band-shaped zone that is substantially parallel to the second edge; (d) folding the web to form a first folded side and a second folded side interconnected by a folded section, the first and second folded sides being substantially vertical and the folded section being at the bottom, and the first and second flangeless zipper strips being substantially aligned with each other; (e) joining the first and second folded sides to each other along lines substantially transverse to the first and second flangeless zipper strips and spaced at regular intervals to form cross seals with pockets therebetween; (f) loading product into each pocket; and (g) inserting sliders at spaced intervals along the first and second flangeless zipper strips, one slider per pocket, the first band-shaped zone being disposed between the first flangeless zipper strip and a first side wall of the slider, and the second band-shaped zone being disposed between the second flangeless zipper strip and a second side wall of the slider.

Another aspect of the invention is a form-fill-seal machine comprising: means for joining a back of a first flangeless zipper strip to a first band-shaped zone of an elongated web of packaging film having first and second edges; means for joining a back of a second flangeless zipper strip to the web along a second band-shaped zone, the first and second edges and the first and second band-shaped zones being substantially mutually parallel; means for folding the web to form a first folded side and a second folded side interconnected by a folded section, the first and second folded sides being substantially vertical and the folded section being at the bottom; means for joining the first and second folded sides to each other along lines substantially transverse to the first and second flangeless zipper strips and spaced at regular intervals to form cross seals with pockets therebetween; means for loading product in each pocket; and a slider insertion device for inserting sliders at spaced intervals along the first and second flangeless zipper strips, one slider per pocket, the first band-shaped zone being disposed between the first flangeless zipper strip and a first side wall of the slider, and the second band-shaped zone being disposed between the second flangeless zipper strip and a second side wall of the slider.

A further aspect of the invention is a method of making reclosable packages, comprising the following steps: (a) providing an elongated web of packaging film having first and second edges that are substantially mutually parallel; (b) interlocking first and second flangeless zipper strips with each other; (c) joining a back of the first flangeless zipper strip to the web along a first band-shaped zone while the first and second flangeless zipper strips are interlocked, the first band-shaped zone being substantially parallel to the first edge; (d) folding the web to form a first folded side and a second folded side interconnected by a folded section, the first and second folded sides being substantially vertical and the folded section being at the bottom; (e) joining the first and second folded sides to each other along lines substantially transverse to the first and second flangeless zipper strips and spaced at regular intervals to form cross seals with pockets therebetween; (f) loading product into each pocket; (g) for each loaded pocket, joining a back of the second flangeless zipper strip to the web along a second band-shaped zone while the first and second flangeless zipper strips are interlocked, the second band-shaped zone being substantially parallel to the second edge; and (h) inserting sliders at spaced intervals along the first and second flangeless zipper strips, one slider per pocket, the first band-shaped zone being disposed between the first flangeless zipper strip and a first side wall of the slider, and the second band-shaped zone being disposed between the second flangeless zipper strip and a second side wall of the slider.

Another aspect of the invention is a method of making reclosable packages, comprising the following steps: (a) folding an elongated web of packaging film having first and second edges; (b) joining a back of a first flangeless zipper strip to the web along a first band-shaped zone that is substantially parallel to the first edge; (c) joining a back of a second flangeless zipper strip to the web along a second band-shaped zone that is substantially parallel to the second edge; (d) joining opposing sides of the folded web crosswise along lines that are substantially orthogonal to the fold and spaced at regular intervals to form pockets, one crosswise line of joinder per package width; (e) loading product into each pocket after steps (a) through (d) have been performed; and (f) inserting sliders at spaced intervals along the first and second flangeless zipper strips, one slider per package width, a slider insertion device for inserting sliders at spaced intervals along the first and second flangeless zipper strips, one slider per pocket, the first band-shaped zone being disposed between the first flangeless zipper strip and a first side wall of the slider, and the second band-shaped zone being disposed between the second flangeless zipper strip and a second side wall of the slider.

A further aspect of the invention is a method of manufacturing comprising the following steps: (a) extending a web of bag making film of constant width under tension in a machine direction, the web having first and second lateral edges and a medial line parallel to the machine direction; (b) joining a first flangeless zipper strip to one side of the web along a first zone of joinder disposed parallel and near to the first lateral edge of the web; (c) joining a second flangeless zipper strip to the one side of the web along a second zone of joinder disposed parallel to the first zone of joinder and in a region between the medial line and the first zone of joinder; (d) joining a third flangeless zipper strip to the one side of the web along a third zone of joinder disposed parallel and near to the second lateral edge of the web; (e) joining a fourth flangeless zipper strip to the one side of the web along a fourth zone of joinder disposed parallel to the third zone of joinder and in a region between the medial line and the third zone of joinder; (f) folding the web in first, second and third zones disposed parallel to the medial line, the first folding zone being disposed in a region of the web that would be between the first and second zones of joinder if the web with joined first through fourth flangeless zipper strips were in a planar configuration, the second folding zone being disposed in a region of the web that would be between the second and third zones of joinder if the web with joined zipper strips were in a planar configuration, and the third folding zone being disposed in a region of the web that would be between the third and fourth zones of joinder if the web with joined zipper strips were in a planar configuration, the web after folding having a generally W-shaped profile; (g) joining first and second walls of the web to each other along lines substantially transverse to the first and second flangeless zipper strips and spaced at regular intervals to form a first set of cross seals with pockets in between, thereby forming a first chain of pockets, each of the first set of cross seals extending from the first folding zone to the first and second flangeless zipper strips; (h) joining third and fourth walls of the web to each other along lines substantially transverse to the third and fourth flangeless zipper strips and spaced at regular intervals to form a second set of cross seals with pockets in between, thereby forming a second chain of pockets, each of the second set of cross seals extending from the third folding zone to the third and fourth flangeless zipper strips; (i) loading product into each pocket of the first and second chains; (j) severing the first and second chains of pockets from a portion of the web that includes the second folding zone; (k) inserting a first set of sliders at spaced intervals along the first and second flangeless zipper strips, one slider per pocket, the first band-shaped zone being disposed between the first flangeless zipper strip and a first side wall of each slider of the first set, and the second band-shaped zone being disposed between the second flangeless zipper strip and a second side wall of each slider of the first set; and (l) inserting a second set of sliders at spaced intervals along the third and fourth flangeless zipper strips, one slider per pocket, the third band-shaped zone being disposed between the third flangeless zipper strip and a first side wall of each slider of the second set, and the fourth band-shaped zone being disposed between the fourth flangeless zipper strip and a second side wall of each slider of the second set.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

The invention is directed to FFS machines capable of making reclosable packages having slider-actuated string zippers. The sliders may have plows (i.e., separating fingers) or not. For the sake of illustration, a reclosable package having a string zipper and a slider with plow will now be described with reference to FIG. 1. The FFS machines encompassed by the present invention include machines to make packages comprising string zippers and sliders different in construction from that depicted in FIG. 1.

Figure 1:
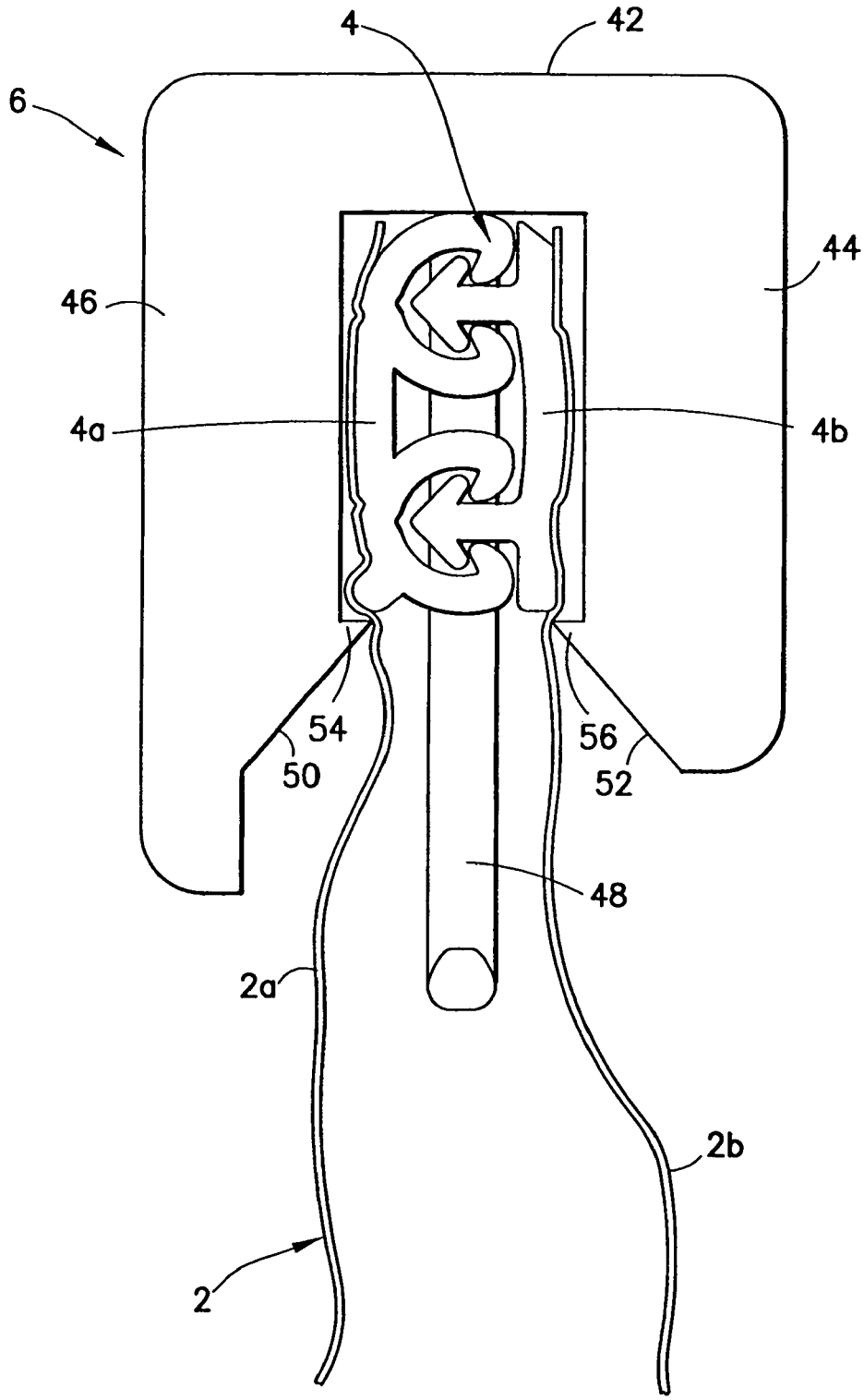
FIG. 1 is a drawing showing a partially sectioned view of a slider-string zipper assembly incorporated in a reclosable package. The zipper and receptacle are shown only in a section plane in front of the closing end of the slider. The portions of the zipper and receptacle disposed behind the section plane have not been shown to avoid cluttering the drawing.

A reclosable package or bag comprising a receptacle 2 and a flexible plastic string zipper 4, operated by manipulation of a slider 6, is partially shown in FIG. 1, adapted from U.S. patent application Ser. No. 10/367,450. The receptacle 2 comprises mutually opposing front and rear walls 2*a* and 2*b* that are joined together (e.g., by conventional conductive heat sealing) at opposite side edges of the receptacle to form respective seams (not shown in FIG. 1). The opposing bottoms of the walls 2*a* and 2*b* may also be joined, for example, by means of a heat seal. Typically, however, the bottom of the package is formed by a fold (not shown) in the original packaging film.

The walls 2*a* and 2*b* of the receptacle 2 may be made from any suitable film material, including thermoplastic film materials such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The thickness of the film is preferably 2 mils or less.

At its top end, the receptacle 2 has an openable mouth, on the inside of which is an extruded plastic string zipper 4. The string zipper 4 comprises a pair of interlockable zipper strips 4*a* and 4*b*. Although FIG. 1 shows a rib and groove arrangement, the profiles of the zipper strips may take any form. For example, the string zipper may comprise interlocking rib and groove elements (as shown in FIG. 1) or alternating hook-shaped closure elements. The preferred zipper material is polyethylene or polypropylene. The top edges of the front and rear walls 2*a* and 2*b* (see FIG. 1) are respectively sealed to the backs of the zipper strips 4*a* and 4*b* by a conventional conduction heat sealing technique.

The string zipper is operated by moving the slider 6 along the zipper strips. The bag partially shown in FIG. 1 further comprises end stops (not shown in FIG. 1) for preventing the slider from sliding off the ends of the zipper when the slider reaches the zipper closed or fully opened position. Such end stops perform dual functions, serving as stops to prevent the slider from going off the end of the zipper and also holding the two zipper profiles together to prevent the bag from opening in response to stresses applied to the profiles through normal use of the bag. In accordance with one embodiment of the invention, the end stops comprise stomped areas on the zipper parts themselves. The stomped end stops may comprise sections of the zipper parts that have been fused together and flattened at the ends of the zipper. During deformation, thermoplastic zipper material flows upward such that the end stops are raised in height above the peak of the undeformed zipper on which the slider rides. Such stomping can be carried out using ultrasonic welding equipment of the type disclosed in U.S. patent application Ser. No. 10/113,489, entitled "Method and Apparatus for Ultrasonically Stomping Slider End Stops on Zipper".

Zipper strip 4*b* comprises a base and two generally arrow-shaped rib-like male closure elements or members projecting from the base. Zipper strip 4*a* comprises two pairs of hook-shaped gripper jaws connected by a sealing bridge. The pairs of gripper jaws form respective complementary female profiles for receiving the male profiles of zipper strip 4*b*. Alternatively, one zipper part could have one male profile and one female profile, while the other zipper part has one female profile and one male profile, or the respective zipper parts could each have more than two male or female profiles. The sealing bridge of zipper strip 4*a* and the base of zipper strip 4*b* are resiliently flexible self-supporting structures having a thickness greater than the thickness of the bag film. The male closure elements are integrally formed with the base, while the female closure elements are integrally formed with the sealing bridge.

The upper margins of the walls 2*a* and 2*b* of the bag are joined to the backs of the sealing bridge and the base respectively, forming band-shaped zones of joinder. The upper margins of the bag film may have short free ends, as seen in FIG. 1, provided that the free ends are not so long as to interfere with travel of the slider along the zipper or become entangled with the zipper profiles.

The slider 10 comprises a top wall 42 and a pair of side walls 44, 46 that form a tunnel for passage of the string zipper 4 therethrough. The width of the tunnel is substantially constant along the section that is divided by the plow 48 and then narrows from a point proximal to the end of the plow to the closing window at one end face of the slider. The closing end of the slider is seen in FIG. 1. The upper margins of the bag walls 2*a* and 2*b*, which are joined to the backs of the zipper strips 4*a* and 4*b*, are disposed between the respective zipper strips 4*a*, 4*b* and the respective side walls 44, 46 of the slider. Also, the slider shown in FIG. 1 has one leg (i.e., side wall 46) longer than the other, to wit, an extension 58 of side wall 46 projects to an elevation lower than the bottom edge of the opposing side wall 44. This design facilitates proper orientation of the slider during automated feeding to a slider insertion device, as explained below.

The plow or divider 48 depends downward from a central portion of the top wall 42 to an elevation below the lowermost portions of each sidewall 44, 46. The plow 48 is disposed between opposing sections of the zipper strips that pass through the tunnel. The tip of the plow 48 is truncated and has rounded edges and flattened corners at opposing ends for facilitating insertion of the plow between the zipper profiles without snagging during automated slider insertion. As the slider is moved in the opening direction (i.e., with the closing end leading), the plow 48 pries the impinging sections of zipper strips 4*a* and 4*b* apart.

In the embodiment depicted in FIG. 1, the slider 10 further comprises a retaining projection or ledge 54 that projects inward from the side wall 44 and a retaining projection or ledge 56 that projects inward from the side wall 46. The ledges 54 and 56 project toward each other, forming respective latches for latching the slider onto the zipper, thereby increasing slider pull-off resistance. The ledges 54 and 56 further comprise respective inclined bottom surfaces 50 and 52 that extend downward and outward from the respective inner edges of the substantially horizontal surfaces. The inclined surfaces 50 and 52 are each substantially planar and serve to guide the respective zipper strips 4*a* and 4*b* into the slider tunnel during automated insertion of the slider onto an open section of the zipper. The sliders are typically inserted at spaced intervals onto a string zipper with joined bag film that is advanced intermittently past automated slider insertion device.

Systems for transporting sliders to a slider insertion device are disclosed in U.S. patent application Ser. No. 10/106,687 filed on Mar. 25, 2002 and entitled "System for Transporting Sliders for Zipper Bags". That application discloses feeding sliders into a slider insertion device by means of a feeder tube that only accepts correctly oriented sliders having an asymmetric profile, i.e., one leg of the slider is longer than the other leg. Similarly, the slider shown in FIG. 1 has one leg (i.e., side wall 46) longer than the other, to wit, an extension 58 of side wall 46 projects to an elevation lower than the bottom edge of the opposing side wall 44. The sliders are launched into the feeder tube by a sender apparatus that is controlled by a programmable controller based on feedback received by the controller from various sensors that detect the presence or absence of sliders at particular locations in the slider transport system. The sliders are pneumatically transported in predetermined quantities from a supply of sliders, e.g., a vibratory hopper, to a loading rack built into or mounted over the slider insertion device.

The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

The present invention is generally directed to methods and apparatus for making reclosable packages having slider-actuated string zippers. More specifically, the apparatus is a form-fill-seal machine having means for providing an elongated web of packaging film having a pair of lateral edges that are substantially mutually parallel; means for joining the back of lengths of two flangeless zipper strips to the web along two band-shaped zones that are respectively substantially parallel to the lateral edges of the web; means for folding the web to form two folded sides interconnected by a folded section and disposed substantially vertical, with the folded section at the bottom; means for joining the first and second folded sides to each other along lines substantially transverse to the first and second flangeless zipper strips and spaced at regular intervals to form cross seals with pockets therebetween; means for loading product in each pocket; and a slider insertion device for inserting sliders having side walls at spaced intervals along the flangeless zipper strips, one slider per pocket. The band-shaped zones of zipper/web joinder pass between the side walls of the slider.

Figure 2:
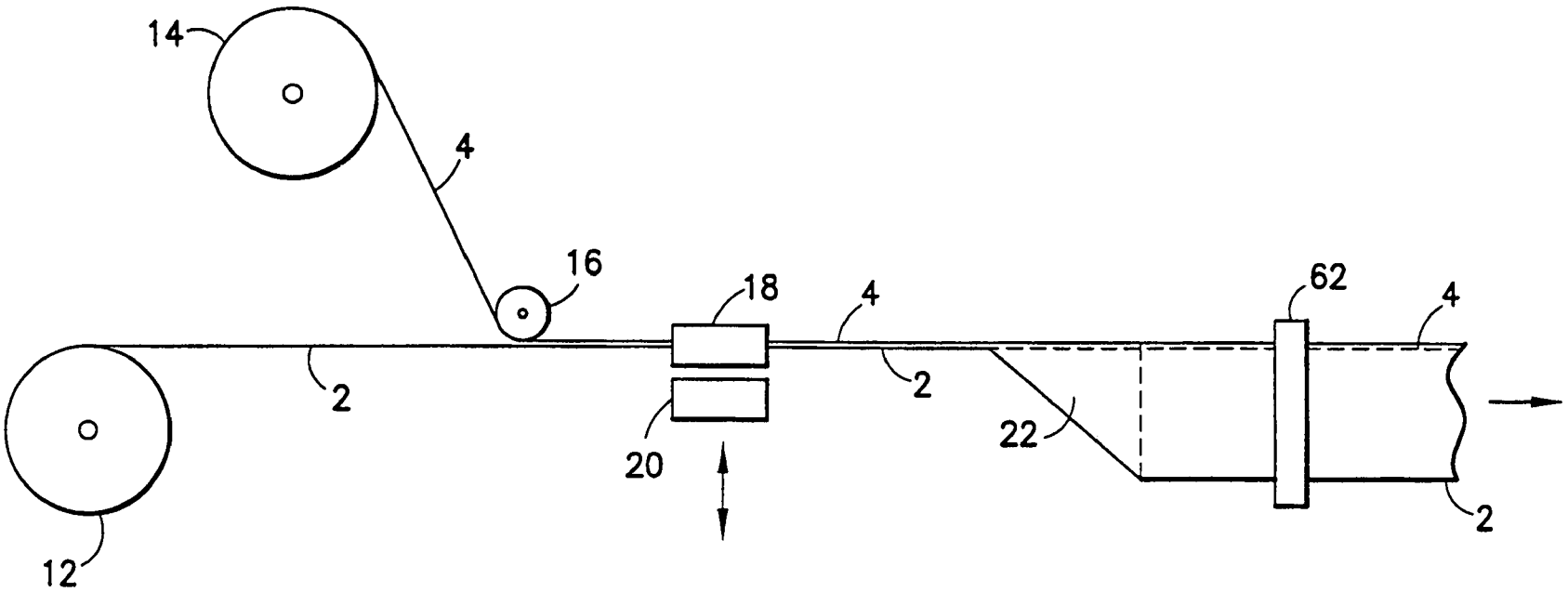
FIG. 2 is a drawing an upstream portion of an FFS machine that operates in accordance with a first method of manufacture.
Figure 3:
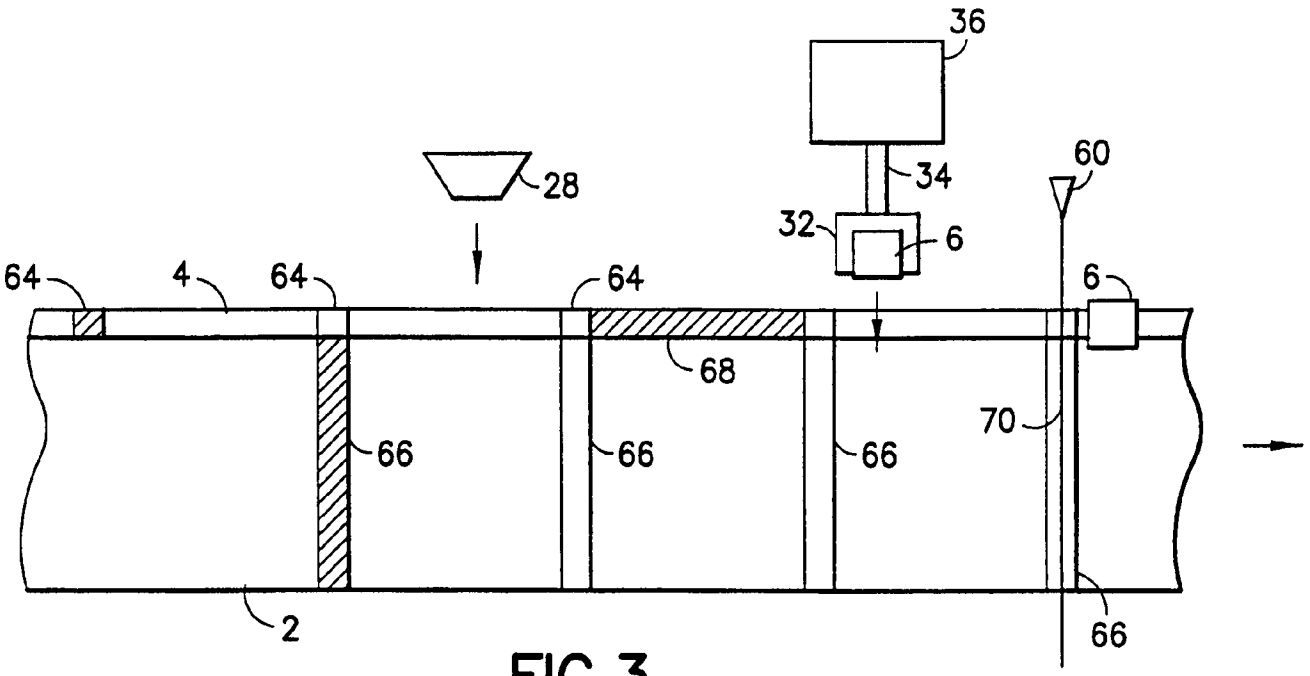
FIG. 3 is a drawing showing a downstream portion of an FFS machine, which can be utilized in conjunction with the upstream portion depicted in FIG. 2 in accordance with the first method of manufacture or with a different upstream portion that inserts the string zipper after the web of bag making material has been folded in accordance a second method of manufacture.

In accordance with a first method of manufacture, a string zipper comprising a pair of interlocked flangeless zipper strips is joined to a film web at or near a lateral edge thereof, and then the web is folded and cross-sealed to form a series of pockets that are filled with product. Portions of equipment that can be used to carry out the first method of manufacture are depicted in FIGS. 2 and 3. In accordance with the first method of manufacture, the portions of the FFS machine depicted in FIGS. 2 and 3 operate intermittently, i.e., during the dwell times that separate successive web advancements. However, sealing the string zipper to the horizontal web can be performed either intermittently or continuously Referring to FIG. 2, a web 2 of packaging film is unwound from a supply roll 12 and pulled forward in a substantially horizontal plane. At the same time, a continuous ribbon or tape of closed string zipper 4 is unwound from a supply reel or spool 14 and laid along the edge of the horizontal web by a guide roller 16. At the sealing station (items 18 and 20 in FIG. 2), one side of a section of string zipper is joined to a marginal portion of the underlying section of web material.

Figure 4:
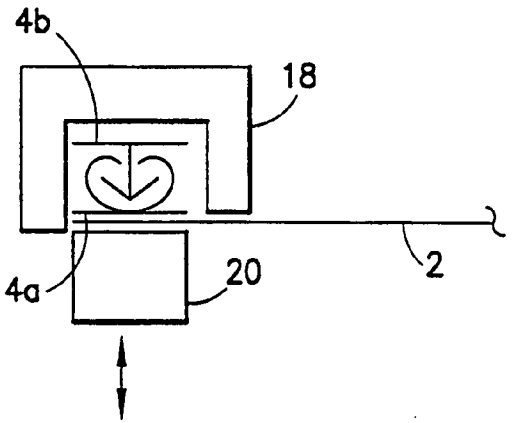
FIG. 4 is a drawing showing a sectional view of a station, included in the machinery depicted in FIG. 2, where string zipper is joined to a web of bag making material.

The relative positions of the string zipper and web of bag making material at the sealing station are depicted in FIG. 4. The string zipper, comprising interlocked flangeless zipper strips 4*a* and 4*b*, is guided into a position parallel to and adjacent or nearly adjacent to an edge of the web 2 by a zipper guide 18. The web 2 is then joined to the back of the adjoining zipper strip 4*a* (hereinafter "the first zipper strip"; the other zipper strip will be referred to hereinafter as "the second zipper strip") by means of a reciprocatable heated sealing bar 20. The heated sealing bar 20 melts or softens the thermoplastic material of the web and/or the zipper strip in a band-shaped zone, which melted or softened thermoplastic then fuses upon cooling to form a permanent seal.

Figure 5:
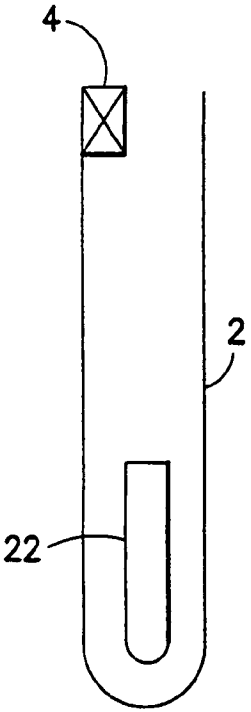

Referring again to FIG. 2, after each dwell time the web 2 with attached string zipper 4 along one edge is pulled by a pair of side rollers 62 (only one of which is visible in FIG. 2, the other being directly behind the roller shown) past a folding board 22. The side rollers may be provided with grooves to provide clearance for the string zipper. The folding board 22 folds the incoming section of web 2 to form two folded sides interconnected by a folded section and disposed substantially vertical, with the folded section at the bottom, as seen in FIG. 5. During folding, the string zipper 4 and the marginal portion of the web 2 that is not yet joined to the zipper are guided (by conventional means not shown in FIG. 5) into respective positions such that the string zipper and that marginal portion of the web confront each other.

Subsequent steps of the first method of manufacture (all of which are performed during dwell times) will now be described with reference to FIGS. 3 and 6–8. These same subsequent steps can also be used when the string zipper is attached to an vertically disposed portion of the folded web, in accordance with an alternative (i.e., second) method of manufacture.

Referring to FIG. 3, during each dwell time the flangeless zipper strips are joined to each other in a spot-shaped area 64 by any conventional means, such as an ultrasonic welding assembly (not shown in the drawings) comprising an anvil and a reciprocatable horn that transmits ultrasound wave energy into the zipper material. The horn and anvil can be designed to shape the thermoplastic zipper material in area 64 into a structure that will also serve as respective slider end stops on two separate packages when the area 64 is later bisected during severance of a completed package from the remainder of the work in process. During the same stomping operation, a confronting portion of the marginal portion of web 20 not yet attached to the string zipper is joined to the adjoining second zipper strip in the same region 64. The formation of a slider end stop structure by the application of ultrasonic wave energy is indicated by the hatched area 64 in FIG. 3, with previously formed slider end stop structures (located downstream of the ultrasonic welding station) being indicated by unhatched areas 64.

At the next station, the two sides of the folded web 20 are joined to each other, e.g., by conventional heat sealing using reciprocatable vertical sealing bars (not shown in the drawings). One or both of the vertical sealing bars are heated. The heated sealing bar applies heat in a band-shaped zone 66 having a centerline that is oriented substantially perpendicular to the string zipper 4. When the web material cools, it fuses to form a cross seal indicated by the hatched zone 66 in FIG. 3. Cross seals located downstream of the cross sealing station are indicated by unhatched zones 66 in FIG. 3. Successive cross seals 66, in combination with the fold at the bottom of the folded web, form a respective pocket that is not sealed at the top (i.e., only one side of the string zipper is attached to one side of the web at this juncture, as seen in FIG. 5).

Figure 6:
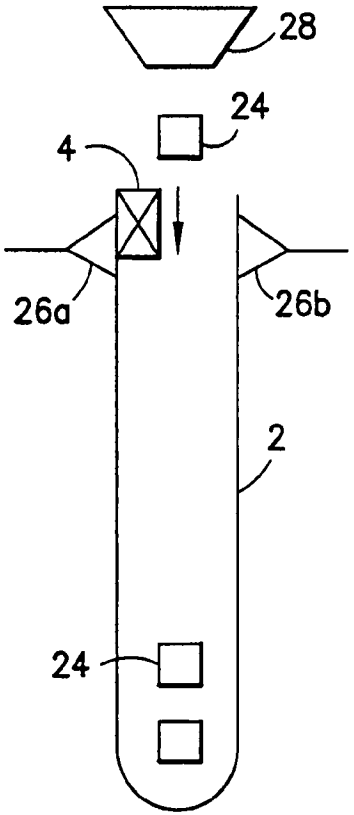

As seen in FIG. 3, the product loading station is located downstream of the cross sealing station. Referring now to FIG. 6, at the product loading station the mouth of each pocket is opened and the pocket is filled by means of a filling device, such as a funnel or chute 28. The pocket may be opened by conventional means, such as a pair of reciprocatable vacuum cups 26*a* and 26*b*. To open the mouth of the pocket, first the vacuum cups are extended, then suction is provided to the cups. The vacuum cups are then retracted while suction is being applied. The suction holds respective portions of the folded sides of the web against the vacuum cups as the latter are retracted, causing the mouth of the pocket to open, as depicted in FIG. 6. Product 24 from the funnel (chute) 28 is dropped through the open mouth and into the interior volume of the pocket.

After product has been loaded into a pocket, the top of that pocket is released from its fully open state by turning off the suction to the vacuum cups to release the two sides of the folded web. The filled pocket is then advanced to a second sealing station where the confronting portion of the unattached marginal portion of the web is joined to the second zipper strip. This can be accomplished, e.g., by conventional heat sealing using reciprocatable horizontal sealing bars 28 and 30, shown in their respective retracted positions in FIG. 7. The sealing bar 28 that confronts the second zipper strip is heated, while the opposing sealing bar 30 that confronts the first zipper strip need not be heated. The horizontal sealing bars in their extended positions will press the unattached marginal portion of the web against the back of the second zipper strip, producing a band-shaped zone of zipper/web joinder (indicated by the hatched zone 68 in FIG. 3) after the melted or softened thermoplastic material of the zipper and/or web has fused. At this juncture, both sides of the closed string zipper are joined to the mouth of the pocket, i.e., the filled pocket is closed.

The filled pocket is then advanced to a slider insertion station (respectively shown in side and end views in FIGS. 3 and 8), where a slider insertion device inserts a slider 6, of a type not having a separating finger or plow, onto the string zipper 4. Alternatively, if the sliders have separating fingers, then a mechanism must be provided for opening each string zipper before the slider is inserted.

Figure 8:
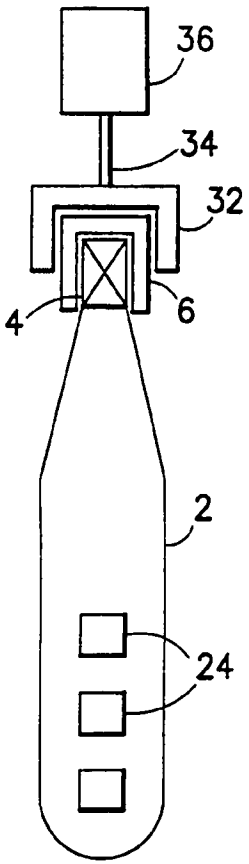
FIGS. 5–8 are drawings showing respective sectional views of respective stages in accordance with the first or second method of manufacture, including folding the web (see FIG. 5); filling a pocket with product (see FIG. 6); joining the unattached side of a string zipper to the web (see FIG. 7); and inserting a slider onto the string zipper (see FIG. 8).
Figure 7:
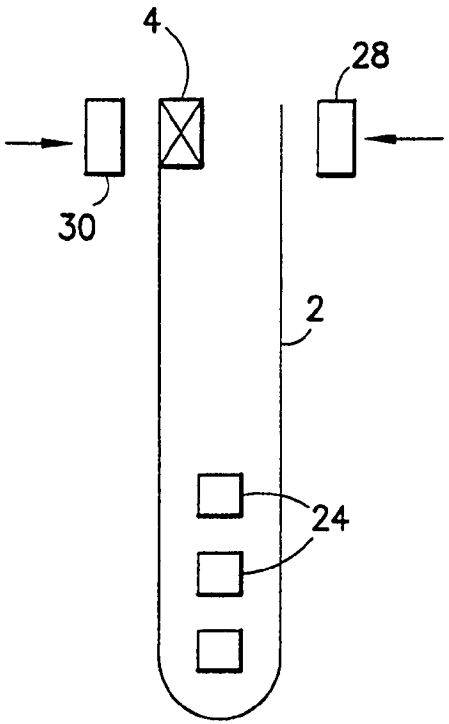

A typical slider insertion device for inserting a finger-less slider onto a closed zipper comprises a pusher 32 that pushes a slider 6 onto a section of the string zipper 4 in a slider insertion zone. The pusher displacement is driven by an air cylinder 36. The pusher is fixed to a distal end of a rod 34 of a piston slidable inside the cylinder 36. The pusher 32 is alternately extended and retracted by actuation of the air cylinder 36, which has two separate ports (not shown) for intake of compressed air from separately controlled air lines. The pusher 32 travels along a straight tunnel or channel (not shown). One sidewall of the channel has an opening that communicates with the end of a slider track (not shown). A succession of sliders are fed periodically along the track by a conventional pneumatic slider feeding system (not shown). When the pusher 32 is retracted (as shown in FIG. 3), the next slider must be automatically fed to a pre-insertion position directly in front of the pusher 32. FIG. 8 shows the pusher in an extended position with a slider 6 inserted onto the string zipper 4.

Thereafter, each cross seal 66 is cut, e.g., along a centerline 70 (see FIG. 3), by a cutting instrument, such as a blade 60, to sever a package from the remaining work in process. Optionally, a conveyor belt (not shown in the drawings), placed below the filled pocket, can be used to move the filled pockets forward to the cutting station. The finished package lands on a take-off belt (not shown), which conveys the package to a collection area.

In accordance with a second method of manufacture, instead of attaching the string zipper to a marginal portion of a horizontal web of bag making material (I.e., before web folding), the string zipper can be attached after web folding.

More specifically, first the web is folded along its centerline and disposed in an upright position with the fold at the bottom; then the string zipper is inserted between marginal portions of the folded web and attached on one side to the confronting marginal portion. A zipper guide and a heated sealing bar (similar to those shown in FIG. 4, except rotated by 90 degrees to account for the now vertically disposed web material) can be used to attach one side of each section of string zipper to one side of a corresponding section of the folded web. Thereafter, the sequence of events depicted in FIGS. 3 and 6–8 can be repeated.

In accordance with a third method of manufacture, a pair of flangeless zipper strips are separately joined to a film web at or near respective lateral edges thereof, and then the web is folded and cross-sealed to form a series of pockets that are filled with product. Equipment for carrying out some of the steps of the third method of manufacture is depicted in FIGS. 9–12.

Figure 9:
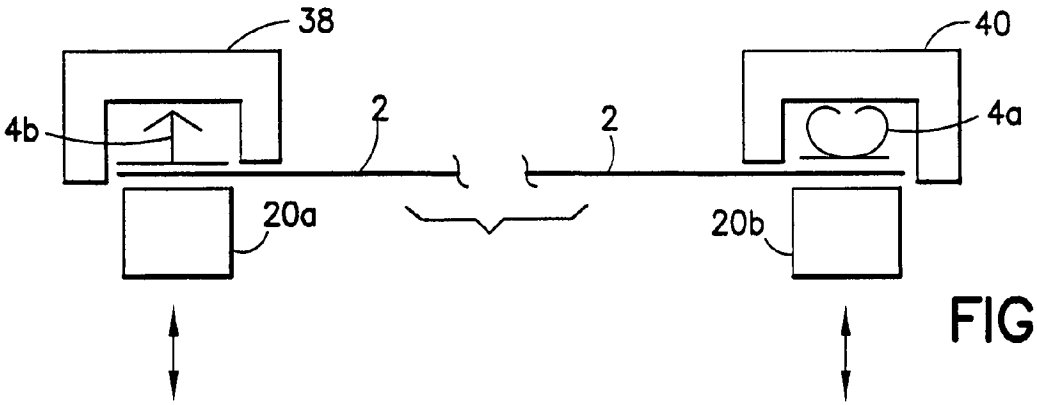
FIG. 9 is a drawing showing a sectional view of a station, disposed upstream of the machinery depicted in FIG. 9, where flangeless zipper strips are joined to respective portions of a web of bag making material.
Figure 11:
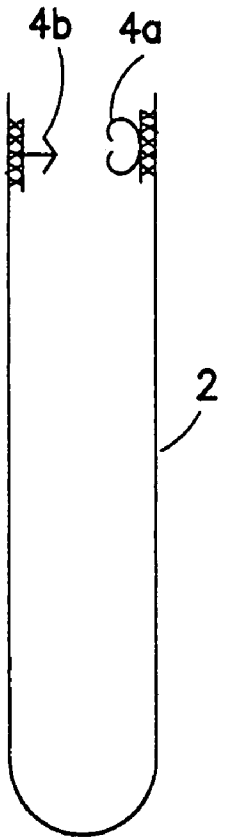

In accordance with the third method of manufacture, a web of packaging film is unwound from a supply roll and pulled forward in a substantially horizontal plane in the manner previously described vis-à-vis the first method of manufacture. At the same time, a first flangeless zipper strip is unwound from one supply reel or spool and laid along one edge of the horizontal web, while a second flangeless zipper strip is unwound from another supply reel or spool and laid along another edge of the horizontal web. The relative positions of the web and zipper strips at this juncture are depicted in FIG. 9. The zipper strip 4*b* is guided to a position overlying one marginal portion of the web 20 by a zipper guide 38, while the zipper strip 4*a* is guided to a position overlying the other marginal portion of the web 20 by a zipper guide 40. The marginal portions web 2 are then respectively joined to the backs of the adjoining zipper strips 4*b* and 4*a* by means of respective reciprocatable heated sealing bars 20*a* and 20*b*. Thereafter, the web is folded as shown in FIG. 11, e.g., by means of a folding board (not shown). The folding board folds the web to form two folded sides interconnected by a folded section and disposed substantially vertical, with the folded section at the bottom, as seen in FIG. 11. The zipper/web seals are represented by respective rows of x's in FIG. 11.

Figure 10:
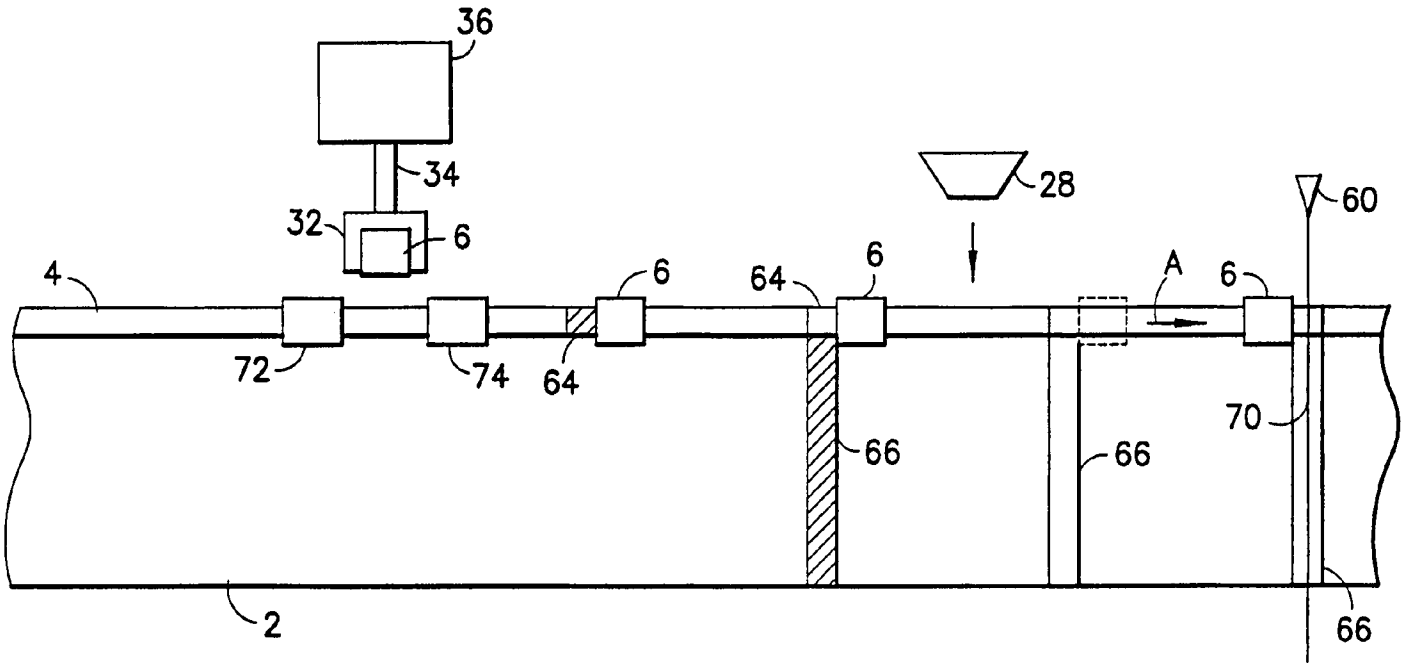
FIG. 10 is a drawing showing a portion of an FFS machine for making slider-operated string-zippered packages in accordance with a third method of manufacture.

After the web is folded, the flangeless zipper strips 4*a* and 4*b* are guided into mutual alignment by a first guide 72 shown in FIG. 10. The first guide 72 aligns the zipper strips at a position upstream of a slider insertion zone. The first guide has a separator plate that is disposed between the zipper strips for maintaining the guided section of string zipper in an open state. A second guide 74 maintains the alignment of the zipper strips at a position downstream of the slider insertion zone. A pusher assembly then inserts a slider onto the zipper strips in the section of zipper located in the slider insertion zone between the guides 72 and 74, with the closing end of the slider being disposed upstream of the opening end of the slider. The pusher assembly may again comprise a pusher 32 fixed on a distal end of a rod 34 of a piston, which is in turn coupled to an air cylinder 36, as previously described in connection with the first method of manufacture. The sliders may have separating fingers or not.

Further in accordance with the third method of manufacture, the flangeless zipper strips are joined to each other in a spot-shaped area by any conventional means, such as an ultrasonic welding assembly (not shown in the drawings), thereby forming a slider end stop structure that will later be bisected during severance of a package from the work in process. The formation of a slider end stop structure by the application of ultrasonic wave energy is indicated by the hatched area 64, with previously formed slider end stop structures (located downstream of the ultrasonic welding station) being indicated by unhatched areas 64.

Figure 12:
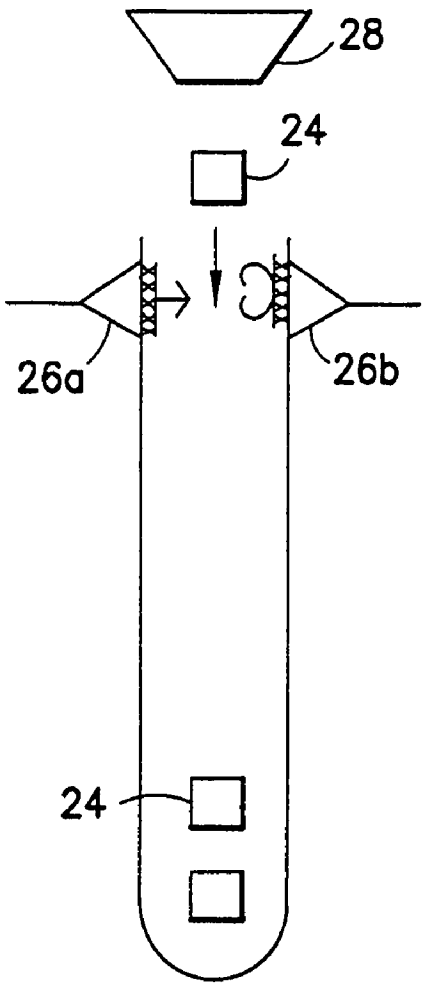
FIGS. 11 and 12 are drawings showing respective sectional views of respective stages in accordance with the third method of manufacture, including folding the web with attached zipper strips (see FIG. 11) and filling a pocket with product (see FIG. 12).

At the next station, the two sides of the folded web 20 are joined to each other, e.g., by conventional heat sealing using reciprocatable vertical sealing bars (not shown in the drawings). One or both of the vertical sealing bars are heated. The heated sealing bar applies heat in a band-shaped zone 66 having a centerline that is oriented substantially perpendicular to string zipper. When the web material cools, it fuses to form a cross seal indicated by the hatched zone 66 in FIG. 10. Cross seals located downstream of the cross sealing station are indicated by unhatched zones 66 in FIG. 10. Successive cross seals 66, in combination with the fold at the bottom of the folded web, form a respective pocket that is not sealed at the top. The mouth of each pocket is then opened to allow the interior volume of the pocket to be loaded with product by means of a filling device, such as a funnel 28. The mouth of the pocket may again be opened by conventional means, such as a pair of reciprocatable vacuum cups 26*a* and 26*b*, which are shown in FIG. 12 in their respective retracted positions. Product 24 from the funnel 28 is dropped through the open mouth and into the interior volume of the pocket.

After product has been loaded into a pocket, the top of the pocket is released from its fully open state by turning off the suction to the vacuum cups to release the two sides of the folded web. The most recently filled pocket is then advanced to a station where, during the next dwell time, the slider 6 is moved relative to the stationary string zipper in a closing direction (indicated by arrow A in FIG. 10), thereby closing the mouth of the package. In FIG. 10, the starting position of the slider 6 is represented by a dashed rectangle (to the immediate left of arrow A) and the final position is represented by a rectangle in solid lines (to the right of arrow A). Thereafter each cross seal 66 is cut, e.g., along a centerline 70 (see FIG. 10), by a cutting instrument, such as a blade 60, to sever a finished package from the remaining work in process.

In accordance with a fourth method of manufacture, instead of attaching the separate zipper strips to the marginal portions of a horizontal web of bag making material (I.e., before web folding), the zipper strips can be attached after web folding and while the marginal web portions are vertically disposed. Thereafter, the sequence of events depicted in FIGS. 10–12 can be repeated.

In accordance with further embodiments of the present invention, pairs of reclosable packages are made concurrently using only one web of bag making film, the packages of each pair being manufactured side by side. The dual manufacture of reclosable packages doubles the capacity of a form-fill-seal machine. The process starts with unwinding a web of bag making film from a roll and threading it through a form-fill-seal machine. At the same time, a pair of string zippers are unwound from respective spools of wound zipper. Coming off of the roll, the web is pulled under tension in a generally horizontal plane. The tensioned film is then folded along three mutually parallel lines or zones to form an upright generally W-shaped profile, as will be described in more detail below. String zippers for two lines of bags are attached to the bag making film before or after folding or in between separate folding operations. The two halves of the triply folded web of bag making film are then cross-sealed at regular intervals to form a chain or series of pockets or receptacles. Successive pairs of pockets (one pocket from each chain) are filled with product. Then the open tops of the filled pockets are closed.

In accordance with a first method of dual manufacture, a web of continuous bag making film is paid out from a roll and advanced in a horizontal plane (in a machine direction) under tension by conventional means (not shown in the drawings). At the same time, a pair of string zippers are unwound in parallel from respective spools of wound zipper. [Each of the string zippers may be of the type depicted in FIG. 1.] Respective portions of the unwound string zippers 4 and 4' are placed atop and sealed to respective marginal portions of the flat tensioned web 2 of bag making film, as seen in FIG. 13. [In FIG. 13, the plane of the web is disposed perpendicular to the plane of the sheet, while the string zippers are represented by x's enclosed in boxes.]

Figure 13:
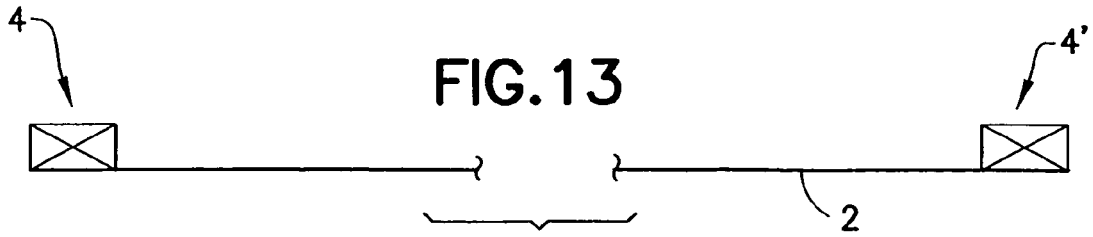
FIGS. 13–16 are drawings showing respective sectional views of respective stages in accordance with a first method of dual manufacture.
Figure 14:
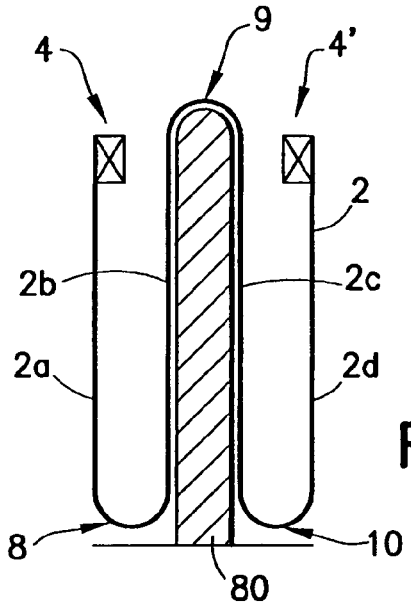

The zipper/web assembly shown in FIG. 13 is folded along three parallel lines to form the triply folded W-shaped structure depicted in FIG. 14. The folded web 2 reverses its direction along the folds 8, 9 and 10 to form a serpentine cross-sectional profile with first and second walls 2*a* and 2*b* on one side of central fold 9, and third and fourth walls 2*c* and 2*d* on the other side of the central fold 9. The bottoms of walls 2*a* and 2*b* are connected along fold 8; the tops of wall 2*b* and 2*c* are connected along central fold 9; and the bottoms of walls 2*c* and 2*d* are connected along fold 10. The string zipper 4 is attached to the top portion of wall 2*a* and confronts a top portion of wall 2*b;* the string zipper 4' is attached to the top portion of wall 2*d* and confronts a top portion of wall 2*c*. The central folded section 9 is supported by an upright support plate 80, which preferably has a profile comprising substantially mutually parallel planar side walls, the surfaces of which are connected by a circular semi-cylindrical surface at the upper end of the support plate. The axis of the semi-cylindrical surface of support plate 80 is aligned in the machine direction, i.e., the direction in which the web of bag making film advances during this stage of manufacture. During film advancement, the central portion of web 2 slides along and is supported by the rounded top of the support plate 80.

In the configuration shown in FIG. 14, the upper portions of walls 2*b* and 2*c* are not sealed to the confronting string zippers 4 and 4' respectively. With the walls 2*a*–2*d* disposed substantially upright, however, slider end stops can be formed on the string zippers by ultrasonic stomping. During this operation, the zipper strips of each string zipper are spot sealed to each other, while at the same time being deformed into a shape suitable for stopping a slider. Also adjoining portions of the walls 2*b* and 2*c* are respectively joined to the stomped portions of string zippers 4 and 4' as a result of this operation. In addition, both sides of the W-shaped web 2 are cross sealed (e.g., in the same manner that cross seal 66, shown in FIG. 3, was formed), each cross seal being aligned with a respective slider end stop to form respective chains or series of pockets that can be filled through a respective gap bounded by a section of string zipper extending between successive slider end stops and the opposing portion of the pocket wall.

Figure 15:
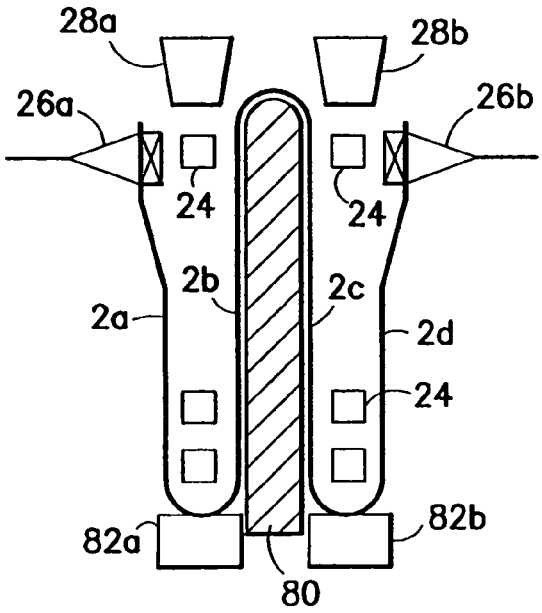

The filling operation is depicted in FIG. 15. The mouths of a pair of side-by-side pockets are opened wider by pulling the upper portions of walls 2*a* and 2*d* (with attached string zippers) away from the central support plate 80 utilizing reciprocatable vacuum cups 26*a* and 26*b*. [This operation has been previously described with reference to FIG. 6.] Product 24 from respective funnels (or chutes) 28*a* and 28*b* is dropped through the open mouths (i.e., through the gaps between the string zippers and the opposing unattached portions of the respective pocket walls) and into the interior volumes of the respective pockets.

Figure 16:
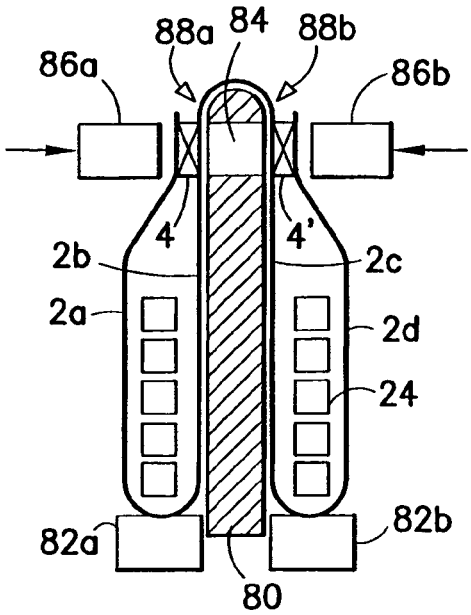

After product has been loaded into each pocket of a pair of pockets, the tops of the pocket are released from their fully open states by turning off the suction to the vacuum cups to release the two walls 2*a* and 2*d* of the folded web. These filled pockets are then advanced with the aid of a pair of conveyor belts 82*a* and 82*b*. The most recently filled pockets are advanced to a sealing station where the confronting unattached portions of walls 2*b* and 2*c* are respectively joined to the string zippers 4 and 4' strip, as seen in FIG. 16. This can be accomplished by heat sealing using reciprocatable horizontal unheated sealing bars 86*a* and 86*b*, which press the string zippers against a heated sealing bar 84 built into the support plate 80. The surfaces on opposite sides of sealing bar 84 are both heated. In its extended position, the unheated sealing bar 86*a* presses the string zipper 4 against one side of the central heated sealing bar 84, with a confronting unattached portion of wall 2*b* between the string zipper 4 and sealing bar 84. Similarly, in its extended position, the unheated sealing bar 86*b* presses the string zipper 4' against the other side of the central heated sealing bar 84, with a confronting unattached portion of wall 2*c* between the string zipper 4' and sealing bar 84. The heated sealing bar 84 softens or melts the web material, which then fuses to the respective string zippers upon cooling. Upon completion of this sealing operation, both sides of the closed string zippers are joined to the mouths of the respective pockets, i.e., the filled pockets of the pair of pockets are closed. If necessary, the heated surfaces of the central sealing bar 84 can be recessed relative to the sides of the support plate 80 so that the web does not contact these heated surfaces when the sealing bars 86*a* and 86*b* are retracted and the web is being advanced.

In the next operation, the central folded web section is cut longitudinally in two places by respective knives (or other cutting instruments) 88*a* and 88*b*, thereby severing the filled and sealed portions of the respective chains of pockets from each other. The severed central folded section of the web is discarded.

The remaining stages of the first method of dual manufacture are not shown in the drawings. The conveyor belts 82*a* and 82*b* carry the respective chains of filled pockets forward to a slider insertion station comprising dual slider insertion devices and dual means for supporting the zippered tops of the pockets during slider insertion. For example, the zippered top of each chain of pockets could be supported by a respective pair of guide bars having a gap therebetween, the width of the gap being such that the bag walls at an elevation below the zipper can pass through the gap, but the zipper strips (which sit atop the guide bars) cannot. A respective pair of mutually opposing drive belts may be provided at an elevation below the guide bars for assisting the conveyor belts in advancing the chains. During each dwell time, each slider insertion device inserts a respective slider, of a type not having a separating finger or plow, onto the string zipper of a respective filled pocket of each pair of pockets. Each slider insertion device may be of the type previously described herein. Alternatively, if the sliders have separating fingers, then a mechanism must be provided for opening each string zipper before the slider is inserted.

After inserting sliders onto the string zippers of a distal pair of filled pockets, the cross seals at the trailing sides of the distal filled pockets are cut, e.g., along a respective centerline, to sever a pair of packages from the remaining work in process. The conveyor belts 82*a* and 82*b* (shown in FIG. 16) move the filled pockets with sliders forward to the cutting station. The finished packages land on a take-off belt (not shown), which conveys the packages to a collection area.

Figure 17:
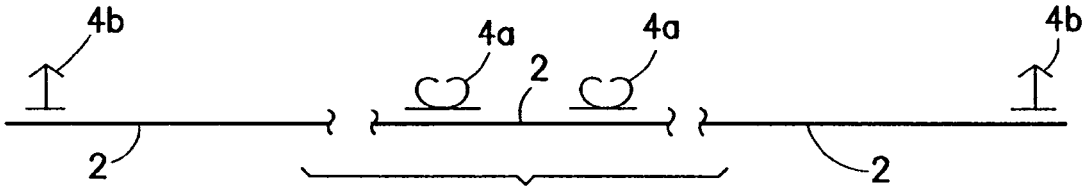
FIGS. 17–20 are drawings showing respective sectional views of respective stages in accordance with a second method of dual manufacture.

In accordance with a second method of dual manufacture, again a web of continuous bag making film is paid out from a roll and advanced in a horizontal plane (in a machine direction) under tension by conventional means. At the same time, two pairs of complementary flangeless zipper strips are unwound in parallel from respective spools of wound zipper strip. [The pairs of flangeless zipper strips may be of the type depicted in FIG. 1, but for purposes of illustration, zipper strips having only a single male or female profile are shown in FIGS. 17–20.] Respective portions of the unwound zipper strips 4*a* and 4*b* are placed atop and sealed to respective portions of the flat tensioned web 2 of bag making film, as seen in FIG. 17. In the example depicted in FIG. 17, the zipper strips 4*b* with male profiles are joined to the marginal portions at the lateral edges of the web 2, while the zipper strips 4*a* with female profiles are joined to the web 2 along interior lines that are parallel to the lateral edges of the web. However, the respective positions of the male and female profiles can be reversed.

Figure 18:
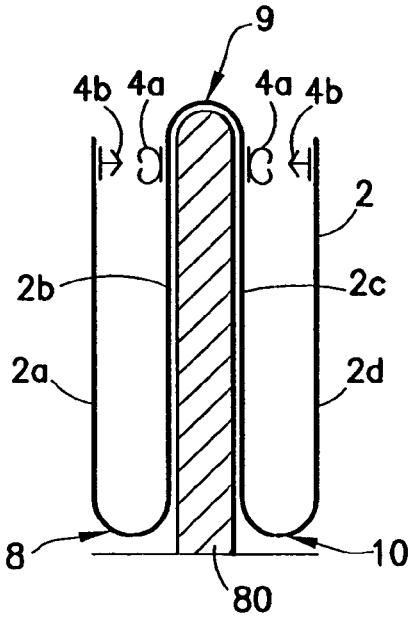

The zipper/web assembly shown in FIG. 17 is folded along three parallel lines to form the triply folded W-shaped structure depicted in FIG. 18. The web 2 is folded in the central region between the female zipper strips 4*a* to form the central fold 9. On each side of the web, the web is also folded in the regions midway between the respective pairs of complementary zipper strips to form folds 8 and 10. The folded web 2 reverses its direction along the folds 8, 9 and 10 to form a serpentine cross-sectional profile with first and second walls 2*a* and 2*b* on one side of central fold 9, and third and fourth walls 2*c* and 2*d* on the other side of the central fold 9. The bottoms of walls 2*a* and 2*b* are connected along fold 8; the tops of wall 2*b* and 2*c* are connected along central fold 9; and the bottoms of walls 2*c* and 2*d* are connected along fold 10. The zipper strips 4*a* are respectively attached to the top portions of wall 2*b* and 2*c*, while the zipper strips 4*b* are respectively attached to the top portions of wall 2*a* and 2*d* in confronting relationship to the zipper strips 4*a*. As was the case for the embodiment depicted in FIG. 14, the central folded section 9 is supported by an upright support plate 80. During film advancement, the central portion of web 2 slides along and is supported by the rounded top of the support plate 80.

In the configuration shown in FIG. 18, the zipper spot sealing (to form slider end stops) and web cross sealing operations are performed, as previously described for the first method of dual manufacture, to form respective chains or series of pockets that can be filled through the-open string zipper of each pocket.

Figure 19:
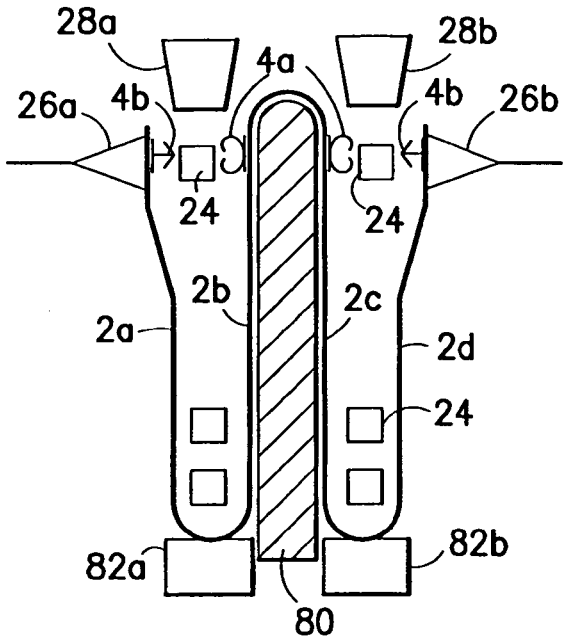

The filling operation is depicted in FIG. 19. The open mouths of a pair of side-by-side pockets are opened wider by pulling the upper portions of walls 2*a* and 2*d* (with attached zipper strips 4*b*) away from the central support plate 80, again employing reciprocatable vacuum cups 26*a* and 26*b* in the manner previously described. Product 24 from respective funnels (or chutes) 28*a* and 28*b* is dropped through the open mouths (i.e., through the gaps between the disengaged zipper strips) and into the interior volumes of the respective pockets until the pockets are filled to the desired level.

After product has been loaded into each pocket of a pair of pockets, the tops of the pocket are released from their fully open states by turning off the suction to the vacuum cups to release the two walls 2*a* and 2*d* of the folded web. These filled pockets are then advanced with the aid of a pair of conveyor belts 82*a* and 82*b*.

Figure 20:
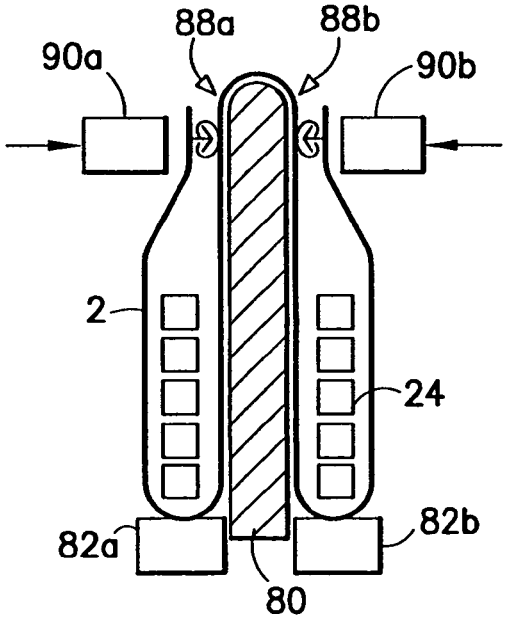

The most recently filled pockets are advanced to a zipper closing station where the zipper strips at the mouth of each pocket are pressed together to close the mouth. This can be accomplished by extending a pair of press bars 90*a* and 90*b* that press the string zippers closed, as seen in FIG. 20. Alternatively, rollers could be substituted for the reciprocatable press bars, each roller being separated from the support plate 80 by a respective gap of a width that allows the string zipper to pass through only if it is closed. As the open string zipper is pulled through the gap during web advancement, the rotating rollers would press the closure profiles of the zipper strips into mutual engagement.

After the string zippers have been closed, the central folded web section is cut longitudinally in two places by respective knives (or other cutting instruments) 88*a* and 88*b*, thereby severing the filled and sealed portions of the respective chains of pockets from each other. The conveyor belts 82*a* and 82*b* move the chains of filled pockets forward to a slider insertion station comprising dual slider insertion devices, as previously described. The remaining steps are the same as those previously described for the first method of dual manufacture.

Figure 21:
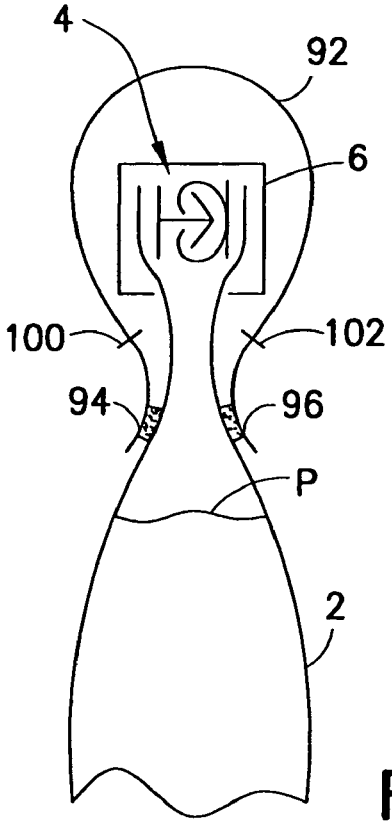
FIG. 21 is a drawing showing a sectional view of a portion of a string-zippered slider-operated reclosable bag having a tamper-evident header.

Optionally, means may be provided for attaching a tamper-evident header on bags manufactured by any of the above-disclosed methods. FIG. 21 shows an upper portion of a string-zippered slider-operated reclosable bag having a tamper-evident header 92 that shrouds the bag mouth. A string zipper 4, operated by a slider 4, is installed inside the mouth. Marginal portions of the header 92 are attached to the web 2 on opposite walls thereof by permanent heat seals 94 and 96. The header 92 provides evidence if someone has previously opened the bag zipper and tampered with the product P. The header 92 can be removed by tearing along lines of weakened tear resistance 100 and 102 located between the bottom of the slider 6 and the heat seals 94 and 96 respectively.

Figure 22:
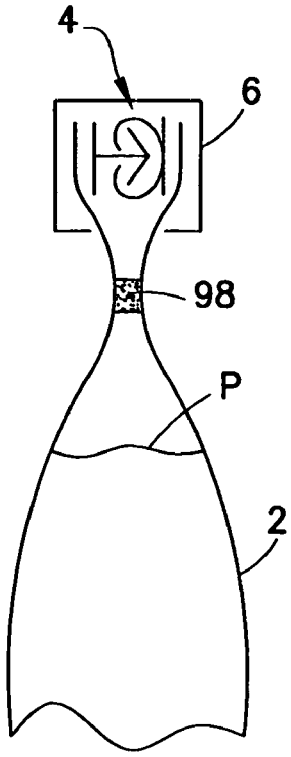
FIG. 22 is a drawing showing a sectional view of a portion of a string-zippered slider-operated reclosable bag having a tamper-evident internal peel seal.

Also, means may be provided for making a tamper-evident peel seal inside bags manufactured by any of the above-disclosed methods. FIG. 22 shows an upper portion of a string-zippered slider-operated reclosable bag having a tamper-evident peel seal 98 that blocks access to the product P inside the bag even after the string zipper 4 has been opened.

The extension and retraction of the pusher of the slider insertion device and various other retractable components described above (e.g., the sealing bars) are achieved in the disclosed embodiment by means of respective air cylinders. Alternatively, hydraulic cylinders could be used. Operation of the cylinders is controlled by a programmable controller (not shown), which selectively activates the supply of fluid to the cylinders in accordance with an algorithm or logical sequence. The controller may also take the form of a computer or a processor having associated memory that stores a computer program for operating the machine.

A person skilled in the art of machinery design will readily appreciate that displacing means other than cylinders can be used to displace the pusher and various other retractable components. Any other known mechanical displacement means can be used. For the sake of illustration, such mechanical displacement devices include a rack and pinion arrangement, rotation of the pinion being driven by an electric motor, or a linear actuator with ball screw driven by an electric motor.

Marginal portions of the web that extend beyond the attached string zipper may be trimmed (e.g., by respective blades or knives) to remove excess material after zipper sealing. Trimming removes excess film that could interfere with smooth travel of the slider along the zipper. The tips of the knives are placed as close to the zipper as possible to minimize the length of the tails that remain after trimming.

After sealing the string zipper to the film web and then trimming the excess film portions extending beyond the edges of the string zipper, optionally any remnant portions may be respectively sealed to the respective zipper strips by a specially designed heated sealing bar that is fully disclosed in U.S. patent application Ser. No. 10/655,991 entitled "Method and Apparatus for Making Reclosable Bags Having Slider-Actuated String Zippers". In that patent application, the operation whereby the free remnants are sealed to the zipper is referred to as "lip sealing". If the cutting lines are located close enough to the respective zipper strips that the remnants of film projecting beyond the zipper are not long enough to interfere with operation of the slider as it moves along the zipper, lip sealing need not be done.

In the various embodiments described above, sealing is accomplished using sealing bars. Alternatively, zipper sealing may be performed while the zipper and web are moving. For example, sealing could be accomplished using a sealing wheel or a drag sealer. In such an instance, part of the operation would be continuous and another part intermittent, with a series of dancer bars converting one to the other.

For example, in the case of a drag sealer, heat from a pair of mutually opposed sealing bars is conducted through respective endless barrier strips (not shown) made of Teflon or similar material, which circulate on respective sets of rollers (not shown). Each Teflon barrier strips passes between a respective side of the folded web and a respective sealing bar In the gaps between the opposing sealing bars, the web and string zipper being sandwiched between and held together by the Teflon barrier strips, that move with the web and zipper and prevent the bag making film from sticking against the stationary heated sealing bars during conduction heat sealing. The Teflon barrier strips and intervening web and zipper pass through the nips of a series of guide rollers. The movement in the zipper sealing station section will be converted to intermittent movement in subsequent stations by a conventional dancer assembly (not shown). In the intermittent advancement phase, the zipper-film assembly is moved one package increment and then stopped for a period of time, i.e., the dwell time, during which time the spot seal and cross seal are applied and the slider is mounted on the zipper. This cycle is repeated.

While the invention has been described with reference to certain embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the verb "joined" means fused, bonded, sealed, adhered, etc., whether by application of heat and/or pressure, application of ultrasonic energy, application of a layer of adhesive material or bonding agent, interposition of an adhesive or bonding strip, etc. As used in the claims, the term "string zipper" means a zipper comprising two interlockable strips that have substantially no flange or fin portions. Further, in the absence of explicit language in any method claim setting forth the order in which certain steps should be performed, the method claims should not be construed to require that steps be performed in the order in which they are recited.

The invention claimed is:

1. A method of making reclosable packages, comprising the following steps:

(a) providing an elongated web of packaging film having first and second edges that are substantially mutually parallel;

(b) joining a back of a first flangeless zipper strip to said web along a first band-shaped zone that is substantially parallel to said first edge;

(c) joining a back of a second flangeless zipper strip to said web along a second band-shaped zone that is substantially parallel to said second edge;

(d) folding said web to form a first folded side and a second folded side interconnected by a folded section, said first and second folded sides being substantially vertical and said folded section being at the bottom, and said first and second flangeless zipper strips being substantially aligned with each other upon completion of steps (a) through (d);

(e) joining said first and second folded sides to each other along lines substantially transverse to said first and second flangeless zipper strips and spaced at regular intervals to form cross seals with pockets therebetween;

(f) loading product into each pocket; and (g) inserting sliders at spaced intervals along said first and second flangeless zipper strips, one slider per pocket, said first band-shaped zone being disposed between said first flangeless zipper strip and a first side wall of said slider, and said second band-shaped zone being disposed between said second flangeless zipper strip and a second side wall of said slider.

2. The method as recited in claim 1, further comprising the step of joining said first and second flangeless zipper strips to each other at regular intervals.

3. The method as recited in claim 1, further comprising the step of severing individual packages by cutting said folded web and said first and second flangeless zipper strips at regular intervals, wherein the cut lines intersect the respective cross seals formed in step (e).

4. The method as recited in claim 1, wherein said joining step comprises severing individual packages by cutting said folded web with a heated blade.

5. The method as recited in claim 1, wherein step (d) is performed after step (b) and before step (c).

6. The method as recited in claim 1, wherein step (d) is performed after steps (b) and (c).

7. The method as recited in claim 1, wherein step (d) is performed before steps (b) and (c).

8. The method as recited in claim 1, further comprising the step of joining a strip of peel seal material to said web.

9. The method as recited in claim 1, further comprising the step of attaching a header to said first and second folded sides of said web.

10. The method as recited in claim 1, further comprising the step of pulling said first folded side away from said second folded side for each pocket before step (f) is performed.

11. The method as recited in claim 1, wherein said dropped product passes between said first and second flangeless zipper strips.

12. A method of making reclosable packages, comprising the following steps:

(a) providing an elongated web of packaging film having first and second edges that are substantially mutually parallel;

(b) interlocking first and second flangeless zipper strips with each other;

(c) joining a back of said first flangeless zipper strip to said web along a first band-shaped zone while said first and second flangeless zipper strips are interlocked, said first band-shaped zone being substantially parallel to said first edge;

(d) folding said web to form a first folded side and a second folded side interconnected by a folded section, said first and second folded sides being substantially vertical and said folded section being at the bottom;

(e) joining said first and second folded sides to each other along lines substantially transverse to said first and second flangeless zipper strips and spaced at regular intervals to form cross seals with pockets therebetween;

(f) loading product into each pocket;

(g) for each loaded pocket, joining a back of said second flangeless zipper strip to said web along a second band-shaped zone while said first and second flangeless zipper strips are interlocked, said second band-shaped zone being substantially parallel to said second edge; and (h) inserting sliders at spaced intervals along said first and second flangeless zipper strips, one slider per pocket, said first band-shaped zone being disposed between said first flangeless zipper strip and a first side wall of said slider, and said second band-shaped zone being disposed between said second flangeless zipper strip and a second side wall of said slider.

13. The method as recited in claim 12, further comprising the step of severing individual packages by cutting said folded web and said first and second flangeless zipper strips at regular intervals, wherein the cut lines intersect the respective cross seals formed in step (e).

14. The method as recited in claim 12, wherein said joining step comprises severing individual packages by cutting said folded web with a heated blade.

15. The method as recited in claim 12, further comprising the step of pulling said first folded side away from said second folded side for each pocket before step (f) is performed.

16. A method of making reclosable packages, comprising the following steps:

(a) folding an elongated web of packaging film having first and second edges;

(b) joining a back of a first flangeless zipper strip to said web along a first band-shaped zone that is substantially parallel to said first edge;

(c) joining a back of a second flangeless zipper strip to said web along a second band-shaped zone that is substantially parallel to said second edge;

(d) joining opposing sides of said folded web crosswise along lines that are substantially orthogonal to the fold and spaced at regular intervals to form pockets, one crosswise line of joinder per package width;

(e) loading product into each pocket after steps (a) through (d) have been performed; and (f) inserting sliders at spaced intervals along said first and second flangeless zipper strips, one slider per package width, said first band-shaped zone being disposed between said first flangeless zipper strip and a first side wall of said slider, and said second band-shaped zone being disposed between said second flangeless zipper strip and a second side wall of said slider.

17. The method as recited in claim 16, further comprising the step of joining said first and second flangeless zipper strips to each other in areas spaced at regular intervals, one area of zipper strip joinder per package width.

18. The method as recited in claim 16, further comprising the step of severing individual packages by cutting said folded web and said first and second flangeless zipper strips at regular intervals, wherein the cut lines intersect the respective crosswise lines of joinder formed in step (d).

19. A method of manufacturing comprising the following steps:

(a) extending a web of bag making film of constant width under tension in a machine direction, said web having first and second lateral edges and a medial line parallel to said machine direction;

(b) joining a first flangeless zipper strip to one side of said web along a first zone of joinder disposed parallel and near to said first lateral edge of said web;

(c) joining a second flangeless zipper strip to said one side of said web along a second zone of joinder disposed parallel to said first zone of joinder and in a region between said medial line and said first zone of joinder;

(d) joining a third flangeless zipper strip to said one side of said web along a third zone of joinder disposed parallel and near to said second lateral edge of said web;

(e) joining a fourth flangeless zipper strip to said one side of said web along a fourth zone of joinder disposed parallel to said third zone of joinder and in a region between said medial line and said third zone of joinder;

(f) folding said web in first, second and third zones disposed parallel to said medial line, said first folding zone being disposed in a region of said web that would be between said first and second zones of joinder if the web with joined first through fourth flangeless zipper strips were in a planar configuration, said second folding zone being disposed in a region of said web that would be between said second and third zones of joinder if the web with joined zipper strips were in a planar configuration, and said third folding zone being disposed in a region of said web that would be between said third and fourth zones of joinder if the web with joined zipper strips were in a planar configuration, said web after folding having a generally W-shaped profile comprising first through fourth walls;

(g) joining said first and second walls of said web to each other along lines substantially transverse to said first and second flangeless zipper strips and spaced at regular intervals to form a first set of cross seals with pockets in between, thereby forming a first chain of pockets, each of said first set of cross seals extending from said first folding zone to said first and second flangeless zipper strips;

(h) joining said third and fourth walls of said web to each other along lines substantially transverse to said third and fourth flangeless zipper strips and spaced at regular intervals to form a second set of cross seals with pockets in between, thereby forming a second chain of pockets, each of said second set of cross seals extending from said third folding zone to said third and fourth flangeless zipper strips;

(i) loading product into each pocket of said first and second chains;

(j) severing said first and second chains of pockets from a portion of said web that includes said second folding zone;

(k) inserting a first set of sliders at spaced intervals along said first and second flangeless zipper strips, one slider per pocket, said first band-shaped zone being disposed between said first flangeless zipper strip and a first side wall of each slider of said first set, and said second band-shaped zone being disposed between said second flangeless zipper strip and a second side wall of each slider of said first set; and (l) inserting a second set of sliders at spaced intervals along said third and fourth flangeless zipper strips, one slider per pocket, said third band-shaped zone being disposed between said third flangeless zipper strip and a first side wall of each slider of said second set, and said fourth band-shaped zone being disposed between said fourth flangeless zipper strip and a second side wall of each slider of said second set.

20. The method as recited in claim 19, further comprising the steps of severing individual packages by cutting said first chain of pockets at regular intervals along transverse cut lines that intersect the respective cross seals formed in step (g) and cutting said second chain of pockets at regular intervals along transverse cut lines that intersect the respective cross seals formed in step (h).

21. The method as recited in claim 19, wherein steps (b) and (d) are performed prior to step (f), and steps (c) and (e) are performed subsequent to step (f), step (b) being performed while said first and second flangeless zipper strips are interlocked, and step (d) being performed while said third and fourth flangeless zipper strips are interlocked.

22. The method as recited in claim 19, wherein steps (b) through (e) are performed prior to step (f), said first and second flangeless zipper strips being interlocked and said third and fourth flangeless zipper strips being interlocked after step (f).

* * * * *